United States Patent [19]

Horowitz et al.

[11] 4,312,514

[45] Jan. 26, 1982

[54] ROLLER SKATE BRAKE

[76] Inventors: Isadore Horowitz, P.O. Box 5874, Bossier City, La. 71010; Reuben B. Klamer, 969 Hilgard, Los Angeles, Calif. 90024

[21] Appl. No.: 110,207

[22] Filed: Jan. 7, 1980

[51] Int. Cl.[3] ..... A63C 17/14

[52] U.S. Cl. ..... 280/11.2; 188/25

[58] Field of Search ..... 280/11.2, 11.21; 188/4 B, 25

[56] References Cited

U.S. PATENT DOCUMENTS

| | | | |
|---|---|---|---|
| 663,913 | 12/1900 | Lindberg et al. | 188/25 |
| 717,900 | 1/1903 | McElfresh | 188/25 |
| 1,933,421 | 10/1933 | Elliotte | 188/25 |
| 2,725,238 | 11/1955 | Day | 280/11.2 |
| 2,780,322 | 2/1957 | Hickle | 188/25 X |
| 3,000,643 | 9/1961 | Levin | 280/11.2 |
| 3,224,785 | 12/1965 | Stevenson | 188/4 B |
| 3,734,244 | 5/1973 | Roddy | 280/11.2 X |

*Primary Examiner*—Joseph F. Peters, Jr.
*Assistant Examiner*—Michael Mar
*Attorney, Agent, or Firm*—Lyon & Lyon

[57] ABSTRACT

A roller skate having a brake assembly attached to at least one wheel journal of the skate. The brake assembly has a brake member which may be selectively and adjustably brought to impart a frictional force against a wheel or wheels of the roller skate. This frictional force reduces the free rotatability of the wheel without otherwise adversely affecting the operational characteristics of the skate.

1 Claim, 5 Drawing Figures

ROLLER SKATE BRAKE

BACKGROUND OF INVENTION

This invention relates to roller skates, more particularly, to means to restrict the rotatability of the wheels of a roller skate.

The wheels of a conventional roller skate are freely rotatable. While this provides maximum speed and enjoyment for the accomplished skater, it provides bruised knees and skinned elbows for the novice skater who finds that the free rotatability of the wheels causes his feet to quickly, easily, and often fly out from beneath him. Therefore, there exists a need in the art for a roller skate brake which allows the beginning skater to restrict the rotatability of the roller skate wheels by applying a frictional force to one or more of the wheels.

It would be beneficial to provide means to adjust the frictional force applied to the wheels so that the wheels may be allowed to rotate more freely as the skater gains confidence and expertise.

It would also be beneficial to provide means whereby the adjustment could be made quickly and easily. Then, even the accomplished skater could use the invention to lock the wheels of the skate and prevent them from rotating in those instances when free rotatability of the wheels is undesirable; such as when negotiaing stairs, entering stores, restaurants and homes, or when simply standing still.

The braking means should provide the same frictional force to the wheel regardless of the direction in which the wheel is rotating.

Lastly, the braking means should not otherwise affect the operational characteristics of the roller skate.

The roller skate brake of the present invention satisfies these needs by providing a roller skate wherein the rotatability of the wheels in either direction may be quickly, easily, selectively and adjustably restricted.

In another embodiment of the invention, the braking means should be capable of quick and easy attachment to conventional skates so that the invention may be used with skates already owned by the skater.

SUMMARY OF INVENTION

The invention comprises means to selectively and adjustably restrict the free rotatability of at least one wheel of a roller skate. In one embodiment the means comprises a channel assembly fixedly attached to the journal box of the front and rear roller skate wheels. A brake member is slidably retained within the channel member of the channel assembly and extends to each of the front or rear wheels of the skate, coming into contact with the periphery of said wheel. Means are provided to retain the brake member in the channel member and to adjust the frictional force the brake member applies to the wheel.

The primary object of this invention is to provide a roller skate which will be an aid to the novice skater who is learning to skate.

More particularly, the object of the present invention is to provide a roller skate wherein a brake means selectively and adjustably restricts the free rotatability of a wheel or wheels of the roller skate without otherwise affecting the operational characteristics of the skate.

Another object of the present invention is to provide means whereby the accomplished skater may quickly lock the wheels of the skate to prevent them from rotating.

Other and further objects of the invention will become apparent to those skilled in the art upon a reading of the description of the preferred embodiment and the appended claims.

In another embodiment of the present invention, the means comprises a brake assembly which is adapted to quickly and easily attach to the individual wheels of a conventional roller skate.

This embodiment obtains the additional object of providing a braking means which may be attached to the skates already owned by the skater.

DESCRIPTION OF THE PREFERRED EMBODIMENT

Figure 1:
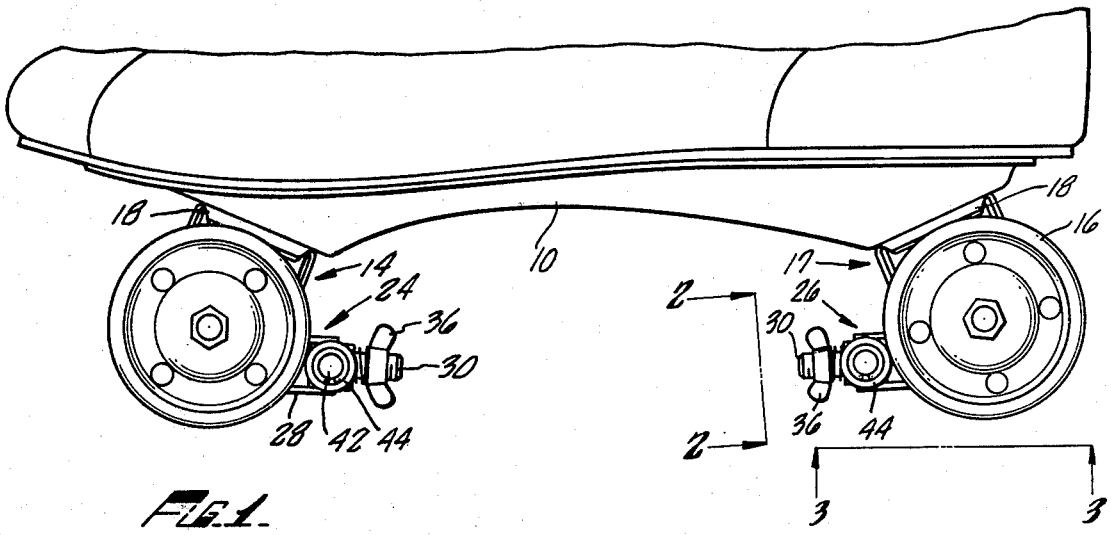
FIG. 1 is a side view of a roller skate embodying the invention.
Figure 2:
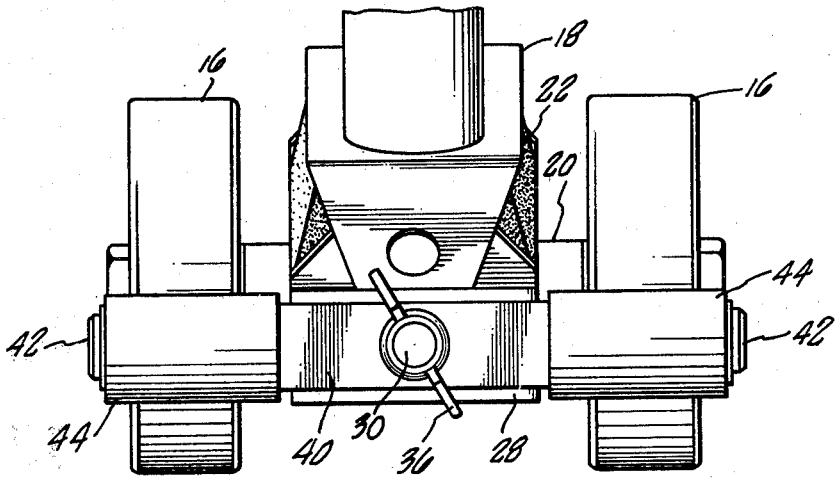
FIG. 2 is a front view of the invention taken along line 2—2 in FIG. 1.
Figure 3:
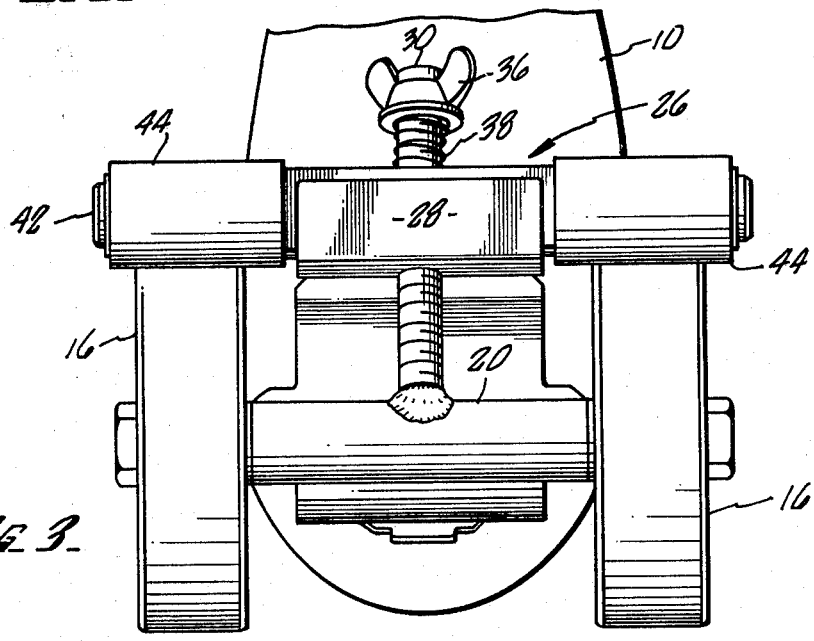
FIG. 3 is a bottom view of the invention taken along line 3—3 in FIG. 1.
Figure 4:
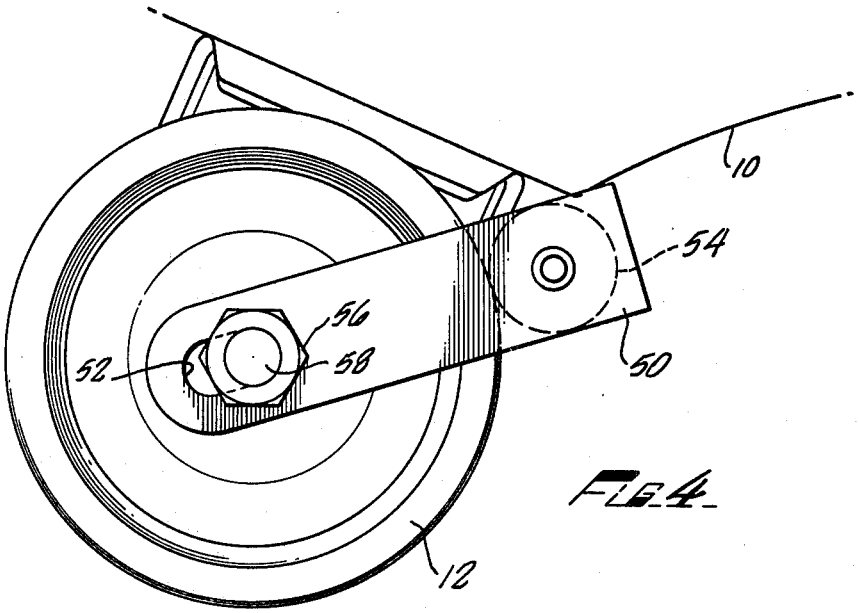
FIG. 4 is a side view of an alternate embodiment of the present invention which is adapted to attach to the wheels of a conventional skate.
Figure 5:
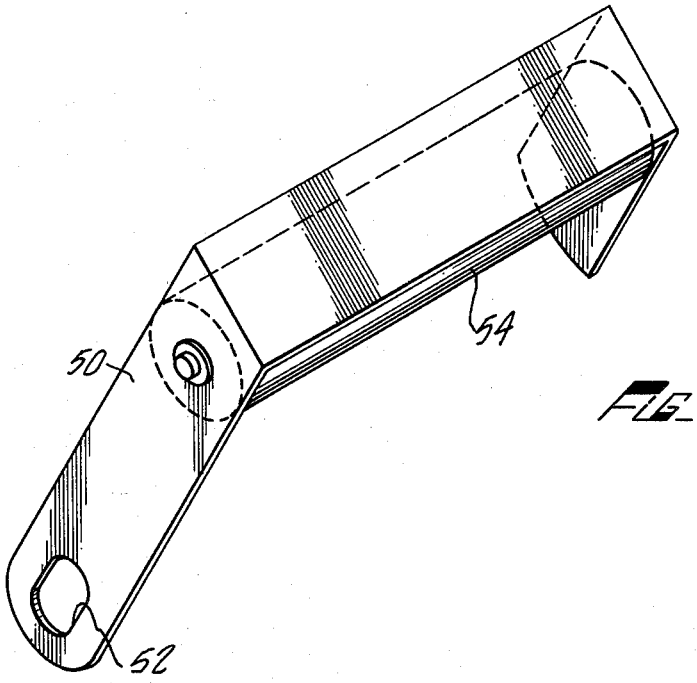
FIG. 5 is a perspective view of the alternate embodiment.

One embodiment of the present invention has a base plate 10 to which front wheels 12 are rotatably attached by means of front journal assembly 14. Back wheels 16 are rotatably attached to the rear of base plate 10 by means of rear journal assembly 17. The wheels 12 and 16 are freely rotatable within said journal assemblies. Journal assemblies 14 and 17 are identical and comprise a bracket 18 fixedly attached to the base plate 10. Journal box 20 is rotatably attached to bracket 18. Rubber plug 22 is positioned between bracket 18 and journal box 20 to restrict the movement of journal box 20 relative to bracket 18.

Front channel assembly 24 is fixedly attached to journal box 20 of front journal assembly 14. When so attached, the channel assembly 24 extends toward the rear of the skate between wheels 12, parallel to base plate 10. Rear channel assembly 26 is identical to front channel assembly 24 except that it extends between rear wheels 16 toward the front of the skate.

Channel assemblies 24 and 26 have a U-shaped channel member 28. Fixedly attached to the base of channel member 28 and extending perpendicularly therefrom is the threaded member 30. Brake member 32 has aperture 34 to freely slide over threaded member 30 and is further shaped to slidably fit into channel member 28. Threaded wingnut 36, preceded by spring 38, engages threaded member 30 to retain brake member 32 within channel member 28 and biased against wheels 12 or 16.

Brake member 32 more specifically comprises a central rectangular portion 40 adapted to slidably fit within channel member 28. The ends of brake member 32 are circular posts 42 to which circular brake drums 44 are rotatably attached. The circular posts 42 and attached brake drums 44 extend a sufficient distance to either side of channel member 28 to engage the periphery of wheels 12 or 16.

By tightening threaded wingnut 36 upon threaded member 30, spring 38 is further compressed causing brake drums 44 to impart an increasing frictional force to wheels 12 or 16 thereby increasingly restricting the free rotatability of said wheels.

By attaching the brake assembly to the wheel journal box as opposed to the base plate, the brake assembly will not restrict the lateral motion of the wheels necessary to navigate a turn.

It will be apparent to those skilled in the art that there are many ways to attach the braking means to the skate.

It will be equally apparent to those skilled in the art from a reading of the appended claims that the invention here claimed is not restricted to the single manner of attachment disclosed.

In another embodiment of the present invention, the braking means is adapted to be attached to the individual wheel of the conventional roller skate. J-shaped plate 50 has elongated aperature 52 in a first end. Brake drum 54 is journaled in the second end of plate 50. The entire assembly is attached to the conventional skate by removing nut 56 from the axle bolt 58, placing plate 50 thereupon and adjusting the position of brake drum 54 to the roller skate wheel by means of elongated aperture 52. Nut 56 is placed on the protruding end of bolt 58 and tightened.

While certain terms have been employed to describe the preferred embodiments of this invention, it is to be understood that those terms are for descriptive purposes only and are in no way intended to limit the scope of this invention. This invention is limited only by the breadth, scope and spirit of the appended claims.

What is claimed is:

1. A roller skate comprising:

(a) a base plate;

(b) wheel journals pivotally attached to said base plate;

(c) at least one front roller skate wheel journaled to one said wheel journal;

(d) at least one rear roller skate wheel journaled to one said wheel journal;

(e) an adjustable brake assembly having;

(1) a channel member fixedly attached to at least one said wheel journal;

(2) a threaded member fixedly attached to said channel member and extending perpendicularly above said channel member;

(3) a brake member adapted to slidably fit on said threaded member within said channel member and having brake drums rotatably attached to its ends which are positioned above said roller skate wheels;

(4) a spring placed upon said threaded members and against said brake member; and (5) a threaded nut to engage said threaded member thereby retaining said brake member within said channel assembly and providing the means to adjust the position of said brake member relative to said roller skate wheel.

* * * * *